US008171590B2

(12) United States Patent
Kim

(10) Patent No.: US 8,171,590 B2
(45) Date of Patent: May 8, 2012

(54) ANTI-EXPANSION JOINT BRIDGE CONSTRUCTED THROUGH DETAILED SURVEY FOR BRIDGE

(76) Inventor: Eun-Joo Kim, Seoul (KR)

( * ) Notice: Subject to any disclaimer, the term of this patent is extended or adjusted under 35 U.S.C. 154(b) by 0 days.

(21) Appl. No.: 13/087,045

(22) Filed: Apr. 14, 2011

(65) Prior Publication Data

US 2011/0252583 A1 Oct. 20, 2011

(30) Foreign Application Priority Data

Apr. 15, 2010 (KR) ..... 10-2010-0034795

(51) Int. Cl.
*E01D 19/06* (2006.01)

(52) U.S. Cl. ..... 14/73.1; 14/73.5; 404/57; 404/58; 52/393

(58) Field of Classification Search ..... 404/56, 404/57, 58, 64, 65, 66, 67; 14/73.1, 73.5; 52/393, 396.02
See application file for complete search history.

(56) References Cited

U.S. PATENT DOCUMENTS

| | | | | | |
|---|---|---|---|---|---|
| 2,069,146 | A * | 1/1937 | Wilhelm | 14/73.1 |
| 3,183,626 | A * | 5/1965 | Schmitt | 52/395 |
| 3,465,532 | A * | 9/1969 | Belden | 405/275 |
| 4,876,759 | A * | 10/1989 | Yang | 14/73.1 |
| 4,901,495 | A * | 2/1990 | Gottschling | 52/396.05 |
| 5,051,024 | A * | 9/1991 | Warthmann | 404/57 |
| 5,171,100 | A * | 12/1992 | Bergstedt et al. | 404/68 |
| 5,600,860 | A * | 2/1997 | Marnetto | 14/73.1 |
| 5,613,797 | A * | 3/1997 | Romagnolo et al. | 404/2 |
| 6,014,848 | A * | 1/2000 | Hilburn, Jr. | 52/396.04 |
| 6,499,265 | B2 * | 12/2002 | Shreiner | 52/393 |
| 2009/0214293 | A1 * | 8/2009 | Wheatley | 404/67 |

FOREIGN PATENT DOCUMENTS

| | | | |
|---|---|---|---|
| JP | 6-280215 | A | 10/1994 |
| JP | 2738025 | B2 | 4/1998 |
| JP | 10-306409 | A | 11/1998 |
| KR | 10-0665273 | B1 | 1/2007 |
| KR | 10-2008-0084775 | A | 9/2008 |

* cited by examiner

*Primary Examiner* — Gary S Hartmann
(74) *Attorney, Agent, or Firm* — Foley & Lardner LLP

(57) ABSTRACT

Disclosed herein is an anti-expansion joint bridge which eliminates an expansion joint structure from an upper structure thereof, and includes a plurality of slidable steel plates to cover a space between girders or floor slabs expanding and contracting on piers and asphalt concrete pavement on the steel plates, so that expansion and contraction of the girders occurring on the piers is prevented from affecting the pavement, thereby ensuring smooth travel of vehicles thereon. The anti-expansion joint bridge includes a pair of expandable/contractible girders separated from each other while constituting an upper structure of the bridge, a plurality of sliding plates overlapping each other on the girders while covering a gap between the girders, and an ascon part covering the pair of girders together with the sliding plates.

7 Claims, 8 Drawing Sheets

Equation 1

$$\text{BM max} = \frac{bh^3}{12}$$

$$= \frac{220*2^3}{12} + \frac{160*4^3}{12} - \frac{160*2^3*0.5}{12} - \frac{160*2^3*0.5}{12} + \frac{220*2^3}{12}$$

$$= \frac{1760}{12} + \frac{10240}{12} - \frac{640}{12} - \frac{640}{12} + \frac{1760}{12}$$

$$= 146.6 + 853.3 - 53.3 - 53.3 + 146.6$$

$$= 1093.2\text{cm}^4$$

Equation 2

$$\text{BM max} = \frac{bh^3}{12} = \frac{600 * 2^3}{12} = \frac{4800}{12} = 400.0\text{cm}^4$$

ANTI-EXPANSION JOINT BRIDGE CONSTRUCTED THROUGH DETAILED SURVEY FOR BRIDGE

BACKGROUND

1. Technical Field

The present invention relate to an anti-expansion joint bridge and, more particularly, to an anti-expansion joint bridge which eliminates an expansion joint structure from an upper structure thereof, and includes a plurality of slidable steel plates to cover a space between girders or floor slabs expanding and contracting on piers and asphalt concrete pavement on the steel plates, so that expansion and contraction of the girders occurring on the piers is prevented from affecting the pavement, thereby ensuring smooth travel of vehicles thereon.

2. Description of the Related Art

It is estimated that the first bridges were made by humans in prehistoric times. These bridges probably took the form of a tree trunk, a wisteria vine, or the like fallen across a river or a valley and were developed from there. It is assumed that in early bridges, cut tree trunks were transported and installed across valleys or rivers. If a single tree trunk was not long enough to span the required distance, several tree trunks then began to be used and, over time, handles or railings were fixed to these early bridges.

Since early bridges were made of natural materials using the characteristics thereof, it is assumed that girder bridges constructed of wooden logs or bridges built from various vines were the first to be built, followed by stone bridges later on.

Generally, a bridge structure expands and contracts depending on load and temperature variation. Thus, the bridge structure, particularly, an upper structure of the bridge, is constructed to a predetermined length or more and has a regular spacing formed between sections thereof (referred to as a 'gap'). An expansion joint device is mounted to the spacing in order to prevent the bridge deck structures from being damaged and to ensure that a vehicle can travel smoothly thereupon.

As such, the expansion joint device, called an expansion joint, is provided to absorb internal stress and prevent breakage of the bridge structure when a material expands and contracts as temperature changes. Typically, such an expansion joint is designed based open previously calculated amounts of expansion and contraction.

However, such an expansion joint has drawbacks of consuming considerable time to construct and complicating a process of paving the bridge with asphalt or concrete.

Further, the expansion joint degrades driving comfort when a vehicle passes over a bridge and is the most likely portion of the bridge to be damaged.

Furthermore, damaged expansion joints are difficult to repair or replace, and during maintenance work, if any, repairmen face considerable danger and traffic congestion may occur.

Here, difficulty in repair or replacement of expansion joints is due to the fact that an anchor bar of the expansion joint is firmly welded to an iron piece embedded in the concrete.

Further, since the expansion joint has substantially the same length as the width of the bridge and has a variety of shapes such as a toothed shape, a slight difference in height from a region near the expansion joint and from the pavement, or unevenness thereof causes vehicles traveling at high speed to be subjected to direct impact, which causes both the extension joint and vehicle tires to be easily damaged and broken.

As such, floor slabs, which constitute an upper structure of the bridge structure, have a gap therebetween, and the expansion joint mounted in the gap has been variously developed up to now.

Particularly, in South Korea, in the course of a project to expand the highway system, huge bridge structures were intensively constructed in the 1980s and 1990s, and rail-type expansion joints which have an expansion allowance of 160 mm-320 mm were typically mounted to bridges constructed during this period. However, expansion joints as currently constructed are subjected to breakage or damage at the rail or lower support structure thereof due to deterioration and external pressure or shock caused by vehicles travelling thereon. Such broken or damaged expansion joints must be frequently replaced.

A conventional expansion joint structure of a floor slab for a bridge structure is shown in FIG. 1. The expansion joint structure includes non-contracting concrete slabs 3, 3' which are fixed by anchor iron pieces to face each other in an upper cavity defined by floor slabs 2, 2' which are coupled to each other and face each other, steel plates 4, 4' which are separated from each other and are fixed to each other by anchor bolts in an upper recess defined by the non-contracting concrete slabs 3, 3', and a flexible expansion joint 10 which is mounted to connect upper portions of the opposite steel plates 4, 4'.

The expansion joint 10 is provided at the surroundings with expansion/contraction grooves 5 which are spaced from the steel plates and defined by connecting the steel plates 4, 4' with each other. The expansion joint 10 is mainly formed of rubber.

In the conventional expansion joint structure constructed as described above, if the floor slabs 2, 2' and the non-contracting concrete slabs 3, 3' expand or contract due to temperature variation, the expansion/contraction grooves 5 of the expansion joint near the steel plates 4, 4' absorb the expansion or contraction of the floor slabs 2, 2' and the non-contracting concrete slabs 3, 3', thereby causing the expansion joint 10 to expand or contract.

However, the conventional expansion joint structure has a problem in that the presence of the expansion/contraction grooves 5 on the expansion joint 10 rattles when vehicles travel thereover, thereby degrading driving comfort. That is, the conventional expansion joint structure has an uneven and irregular upper surface, thereby significantly deteriorating driving comfort.

Further, the expansion joint 10 located on top of the bridge structure is likely to be broken due to load applied during vehicle passage, and the load applied to the upper portion of the expansion joint 10 is focused upon one end of the expansion joint 10 as well, thereby causing breakage of the end of the expansion joint 10.

Moreover, the expansion/contraction grooves 5 also cause further breakage of the end of the non-contracting concrete slabs 3, 3' since the grooves are located between the non-contracting concrete slabs 3, 3'.

That is, when a vehicle passes over the expansion/contraction grooves 5, rattling shock occurs and is transferred to the end of the non-contracting concrete slabs 3, 3', which increases the likelihood of breakage.

If defects such as breakage, failure, or the like occur on such an expansion joint, water leakage occurs and a bridge seat structure supporting the floor slab of the bridge becomes rusty, resulting in fatal damage. In this case, rust stains on a capping stone on a pier detract from the appearance of the bridge and cause concrete structures to be subjected to severe fracture and breakage.

Particularly, if a portion of the non-contracting concrete slabs 3, 3' is damaged, assembly of the expansion joint 10 becomes defective, thereby causing bridge failure and exposing the pier to a danger of collapse.

Further, since the expansion joint 10 exposed through the expansion/contraction grooves 5 is likely to suffer from breakage owing to load applied by vehicles travelling thereover and internal stress caused by expansion and contraction of the non-contracting concrete slabs 3, 3', the damaged expansion joint 10 must be frequently replaced, thereby causing considerable costs associated with replacement of the expansion joint 10.

BRIEF SUMMARY

One aspect of the present invention is to provide an anti-expansion joint bridge which is capable of preventing running noise and friction when vehicles travel over the bridge and is wells suited to a bridge structure which expands and contracts depending on load and temperature variation.

Another aspect of the present invention is to provide an anti-expansion joint bridge capable of coping with expansion and contraction of a bridge structure and preventing a portion of a pier from being damaged through decentralization of load applied thereto without employing an expansion/contraction groove between piers for absorbing expansion and contraction of the bridge structure.

A further aspect of the present invention is to provide an anti-expansion joint bridge capable of eliminating a need for frequent replacement of an expansion joint, which is caused by exposure to exposure to the outside and occurrence of resultant damage, thereby reducing financial loses.

In accordance with one aspect of the invention, an anti-expansion joint bridge includes: a pair of girders separated from each other while constituting an upper structure of the bridge, the girders being able to expand and contract; a plurality of sliding plates overlapping each other on the girders while covering a gap between the girders; and an ascon part covering the pair of girders together with the sliding plates.

The sliding plate may include a bent step and a receiving portion defined in a horizontal direction.

The plurality of sliding plates may overlap each other side by side in the horizontal direction such that one end of each of the sliding plates is received in a receiving portion of an adjacent sliding plate and the other end of the sliding plate defines the receiving portion of the sliding plate.

The one end of the sliding plate received in the receiving portion may be movable in the receiving portion.

The anti-expansion joint bridge may further include a sliding membrane provided between the sliding plates and the ascon part to cover the sliding plates such that the sliding plates are slidable in the state of being covered by the ascon part.

The sliding membrane may comprise a plurality of sliding membranes which are dispersed so that ends thereof cross each other.

The plurality of sliding membranes may be arranged in a multilayer structure.

The sliding membrane may be formed of heat-resistant synthetic resin capable of withstanding heat from the ascon part during installation of the ascon part.

The sliding membrane may be formed of a polyester film.

BRIEF DESCRIPTION OF THE DRAWINGS

The above and other aspects, features and advantages of the invention will become apparent from the following description of exemplary embodiments given in conjunction with the accompanying drawings, in which.

DETAILED DESCRIPTION

Figure 1:
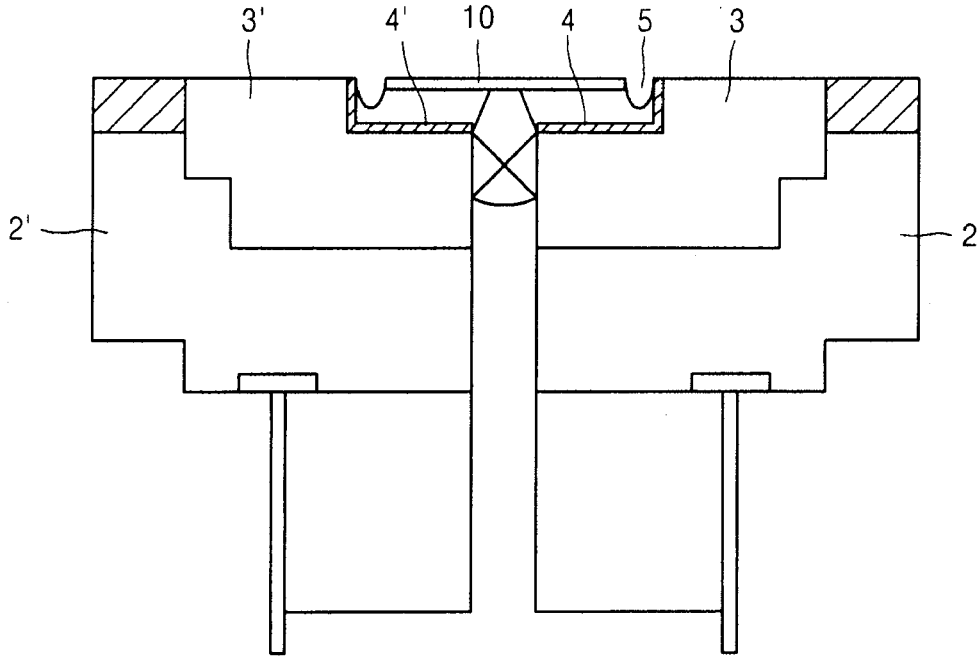
Fig. 1 (PRIOR ART)
FIG. 1 is a sectional view of a conventional expansion joint structure of a floor slab for a bridge structure.

Exemplary embodiments of the invention will now be described in detail with reference to the accompanying drawings. The following embodiments are given by way of illustration to provide a thorough understanding of the invention to those skilled in the art. Hence, it should be understood that the embodiments of the invention are different from each other but are not exclusive with respect to each other. For example, certain shapes, configurations and features disclosed herein may be realized by other embodiments without departing from the spirit and scope of the invention. Further, it should be understood that positions and arrangement of individual components in each of the embodiments may be changed without departing from the spirit and scope of the invention. Therefore, the following detailed description should not be construed as limiting the claims to the specific embodiments, but should be construed to include all possible embodiments along with the full scope of equivalents to which such claims are entitled. Like elements are denoted by like reference numerals throughout the specification and drawings.

Hereinafter, exemplary embodiments of the present invention will be described in detail with reference to the accompanying drawings to allow a person having ordinary knowledge in the art to easily implement the present invention.

Although the discussion below will refer to an anti-expansion joint-bridge which is applied to a bridge undergoing expansion and contraction caused by temperature variation and load in order to allow motor vehicles to smoothly and safely travel over the bridge without obstruction by the expansion and contraction of the bridge, it should be noted that the invention is not limited thereto and the anti-expansion joint bridge, particularly, the configuration of a sliding plate 200, according to the invention may also be applied to various types of bridges to allow trains and other vehicles to smoothly and safely travel thereover.

A bridge is a structure spanning and providing passage over a gap or a barrier. Various kinds of bridges can be provided depending on the structure to be supported or the types of vehicles to be transported thereby.

However, most bridges have substantially the same functions and characteristics. First, since the bridge must permit safe passage therethrough, it is necessary for the bridge to have sufficient strength and durability.

Next, since most bridges are public goods, it is necessary for the bridge to be as cost effective as possible. To this end, the bridge must be designed to ensure safety, utility and economic feasibility through selective combination of materials and structures according to the principles of civil engineering.

Generally, such a bridge includes a pier supporting the bridge and a girder disposed on the pier to allow a vehicle, train or person to pass thereover.

The pier and the girder of the bridge will be described below in more detail in description of an anti-expansion joint bridge according to an exemplary embodiment of the invention.

Figure 2:
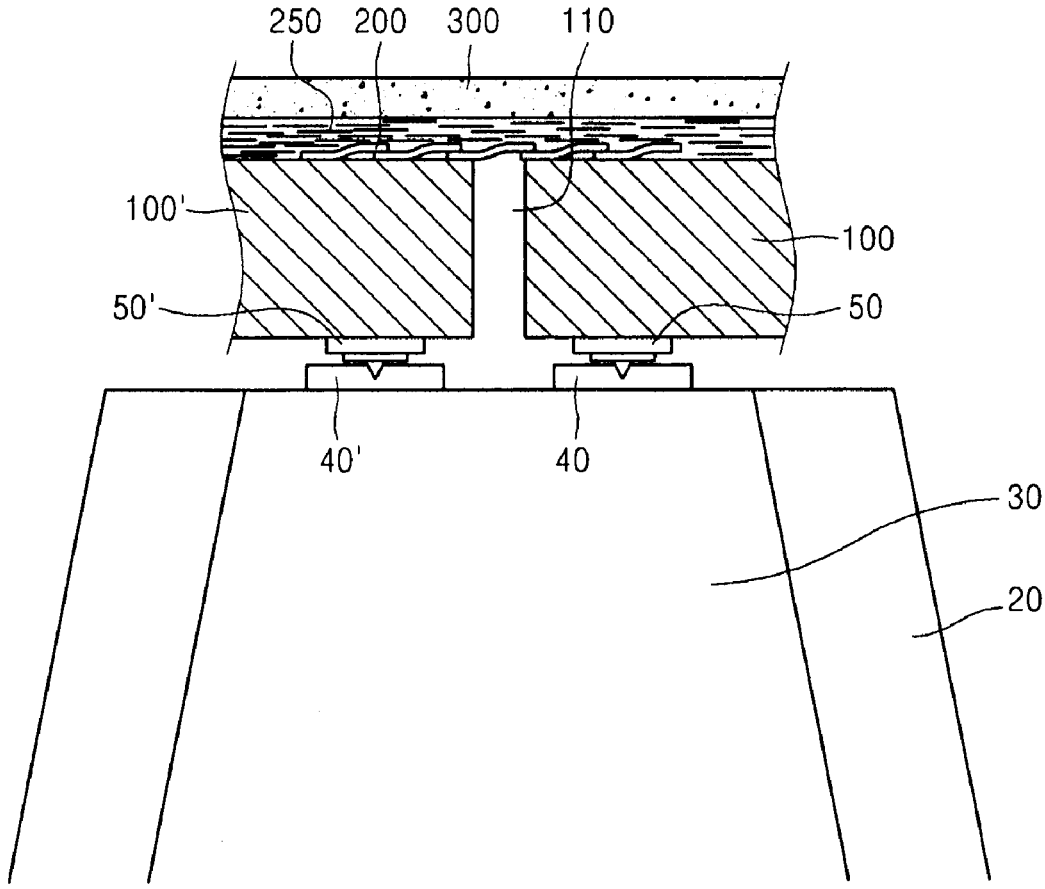
FIG. 2 is a sectional view of an anti-expansion joint bridge according to an exemplary embodiment of the invention.

FIG. 2 is a view of an anti-expansion joint bridge according to an exemplary embodiment of the invention.

Referring to FIG. 2, an upper structure of the bridge according to the embodiment includes a pair of girders 100, 100', which expand and contract according to temperature variation and load.

A contraction groove 110 is defined between the girders 100, 100' and provides a space which allows for expansion and contraction of the girders 100, 100'.

The girders 100, 100' are separated from each other to expand and contract while constituting the upper structure of the bridge.

The bridge further includes support shafts 50, 50' which are disposed under the girders 100, 100' and vertically extend downwards.

The support shafts 50, 50' are provided at lower sides thereof with shaft supports 40, 40', which firmly support the corresponding support shafts 50, 50', respectively.

The bridge further includes a concrete foundation 30 supporting the shaft supports 40, 40', and a pillar 20 formed under the shaft supports 40, 40' to ensure that the concrete foundation 30 firmly supports the shaft supports 40, 40'.

In addition, a wire and an anchor may be used to more firmly secure the girders 100, 100'.

In particular, it is desirable that the girders 100, 100', the support shafts 50, 50', the shaft supports 40, 40', the concrete foundation 30 and the pillar 20 be firmly connected to each other via pot bearings by anchors, beams, bolts, nuts, and the like.

Since the anchor, beam and the pot bearing are well-known in the art, detailed descriptions thereof will be omitted herein.

Next, the upper structure of the bridge structure will be described in more detail. On an upper surface of the girders 100, 100', a plurality of sliding plates 200 is disposed to overlap each other and cover a separation between the girders 100, 100', and an ascon part 300 for pavement covering the sliding plates 200.

Further, the bridge structure includes a sliding membrane 250 interposed between the sliding plate 200 and the ascon part 300 to cover upper surfaces of the sliding plates 200 such that the sliding plates 200 covered with the ascon part 300 can slide.

The sliding membrane 250 may be a thin membrane formed of a synthetic resin. Specifically, the sliding membrane may be formed of a polyester film.

The sliding membrane 250 may comprise a plurality of sliding membranes 250 which overlap each other in a scattered state to form a multilayer structure.

Such a joint bridge structure may be built by firmly establishing the concrete foundation 30 and the pillar 20 on the ground, placing the shaft supports 40, 40' on the concrete foundation 30 and the pillar 20, placing the support shafts 50, 50' on the shaft supports 40, 40', and placing the girders 100, 100' on the support shafts 50, 50'.

Further, the sliding plates 200 are disposed on the girders 100, 100' to cover the contraction groove 110, and the plurality of sliding membranes 250 are then disposed on the sliding plates 200. Then, the ascon part 300 is formed on the sliding film 250.

Herein, the term "ascon" is an abbreviation of asphalt concrete and is also called asphalt, asphalt concrete, asphalt mixture, binders for hot-mixing/hot-laid bituminous pavement, and the like. A typical asphalt concrete mixture is prepared by mixing asphalt with coarse aggregates such as gravels, small aggregates such as sand or mineral fillers for pavement at high or room temperature. Such a typical asphalt concrete mixture is used for pavement of a road or parking lot and is classified into various types depending on usages, functions, and preparation processes.

Further, the term "asphalt" means a black or dark brown solid or semi-solid thermoplastic material that is formed from thousands of different types of macromolecular hydrocarbon (CH) and contains organic compounds and a minute amount of inorganic compounds. It is also called asphalt cement in the U.S. and bitumen in Europe.

Since the ascon part 300 contains plastics which prevent the ascon part 300 from being damaged even when undergoing expansion and contraction due to temperature variation, the bridge of the embodiment may eliminate the need for an expansion joint.

Since spanning members for connecting a plurality of piers to each other are likely to break and even a continuous bridge has at most three spans, a conventional bridge is provided with expansion joints. However, the anti-expansion joint bridge according to the embodiment eliminates the expansion joint and includes the sliding plates 200 between the girders 100, 100' and the ascon part 300 to span a gap between the piers such that the piers separated from each other can be bridged by the sliding plates 200.

Accordingly, the plurality of sliding plates 200 may be disposed to compensate for expansion and contraction of the piers and the ascon part 300.

The ascon or asphalt is well known in the art, and a detailed description thereof will be omitted herein.

Figure 3:
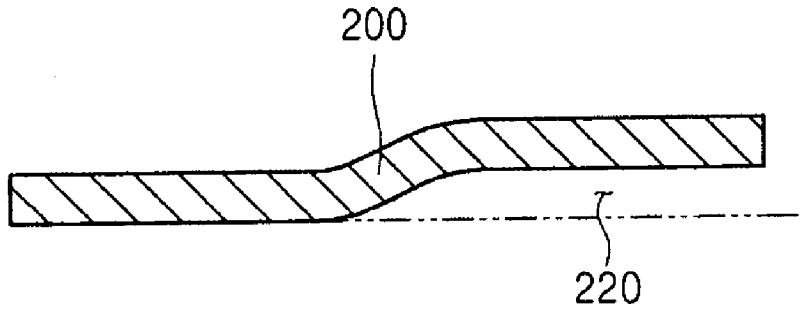
FIG. 3 is a sectional view of a siding plate of the anti-expansion joint bridge according to the embodiment of the invention.
Figure 4:
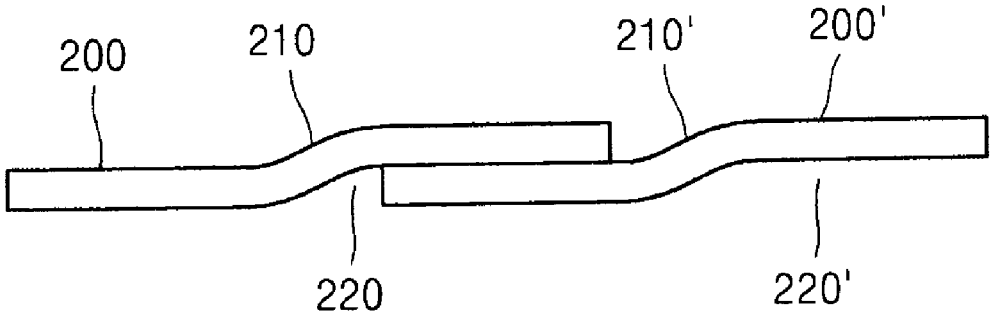
FIG. 4 is a sectional view of the coupled siding plates of the anti-expansion joint bridge according to the embodiment of the invention.

FIGS. 3 and 4 are side sectional views of the siding plate 200 of the anti-expansion joint bridge according to the embodiment of the invention.

Referring to FIGS. 3 and 4, the sliding plate 200 includes a bent step 210 and a receiving portion 220 defined in a horizontal direction.

The plurality of sliding plates 200 overlap each other side by side in the horizontal direction such that one end of each of the sliding plates 200 is received in a receiving portion 220 of an adjacent sliding plate and the other end of the sliding plate 200 defines a receiving portion 220 of the sliding plate 200.

Further, the bent step 210 of the sliding plate 200 allows the sliding plates 200 to slide smoothly where the sling plates 200 overlap.

For the same cross-sectional area and the same material, the bent step 210 of the sliding plate 200 enhances bending prevention properties of a cross-section which resists external force, thereby preventing the sliding plate from being bent.

Further, the plurality of sliding plates 200 may be disposed on the girders 100, 100' to partially cover the upper surfaces of the girders 100, 100' and to smoothly move into the receiving portions 220 of the sliding plates 200, which overlap each other in the horizontal direction while covering the contraction groove 110 between the girders 100, 100', upon expansion and contraction of the girders 100, 100'.

The sliding plates 200 may be formed of metal, for example, steel, and a lubricant may be applied to overlapping portions of the sliding plates 200 to facilitate movement of the sliding plates 200 with respect to each other.

Figure 8:
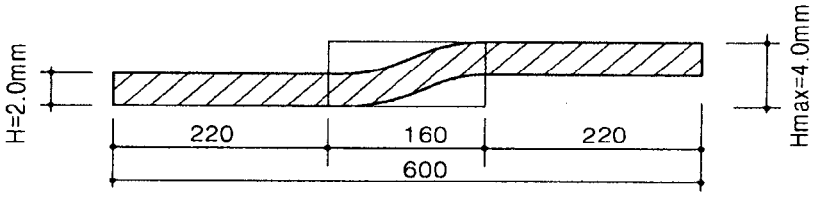
FIG. 8 shows Equation 1 as applied to the bending moment of sliding plate 200.

A bending moment of the sliding plate 200 can be calculated by Equation 1 as shown in FIG. 8.

Herein, "BM max" represents the maximum bending moment.

The term "bending moment" refers to bending force encountered when moment is applied to the beam.

A bending moment at any point in a beam may be calculated by multiplying force applied thereto by the distance between the point and the force.

When load is applied to a beam, the beam is subjected not only to shear force, but also to a moment tending to bend the beam, that is, a bending moment.

A bending moment at a certain cross-section may be calculated from the equilibrium equation. For example, a bending moment of the sliding plate 200 of the anti-expansion joint bridge according to the embodiment can be calculated by Equation 1. That is, assuming that the sliding plate 200 has a horizontal length of 600 mm, a total height of 0.4 mm, and a length of 160 mm at a bent section thereof, the maximum bending moment is 1093.2 $cm^4$.

Figure 9:
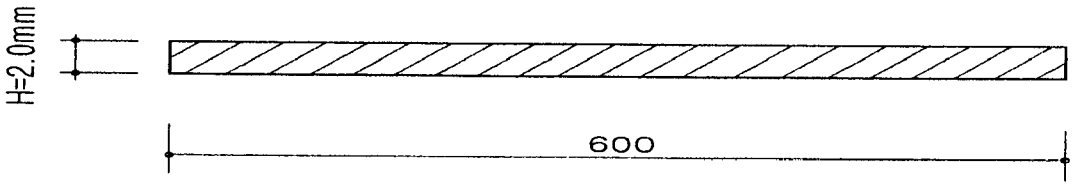
FIG. 9 shows Equation 2 as applied to the bending moment of a steel bar.

Further, a bending moment of a steel bar can be calculated by Equation 2 as shown in FIG. 9.

Assuming that a steel bar has a horizontal length of 600 mm and a total height of 2.0 mm, the maximum bending moment of the steel bar is 400.0 $cm^4$.

Accordingly, the ratio of the bending moment of the sliding plate 200 according to the embodiment to the bending moment of the typical steel bar is as follows:

Ratio=1093.2/400.0=2.73.

As a result, it can be seen that the bending moment of the sliding plate 200 of the anti-expansion joint bridge according to the embodiment is higher than that of the typical steel bar.

This means that the sliding plate 200 of the anti-expansion joint bridge according to the embodiment may better resist load applied thereto by a vehicle running on the ascon part 300 than any other structure.

Figure 5:
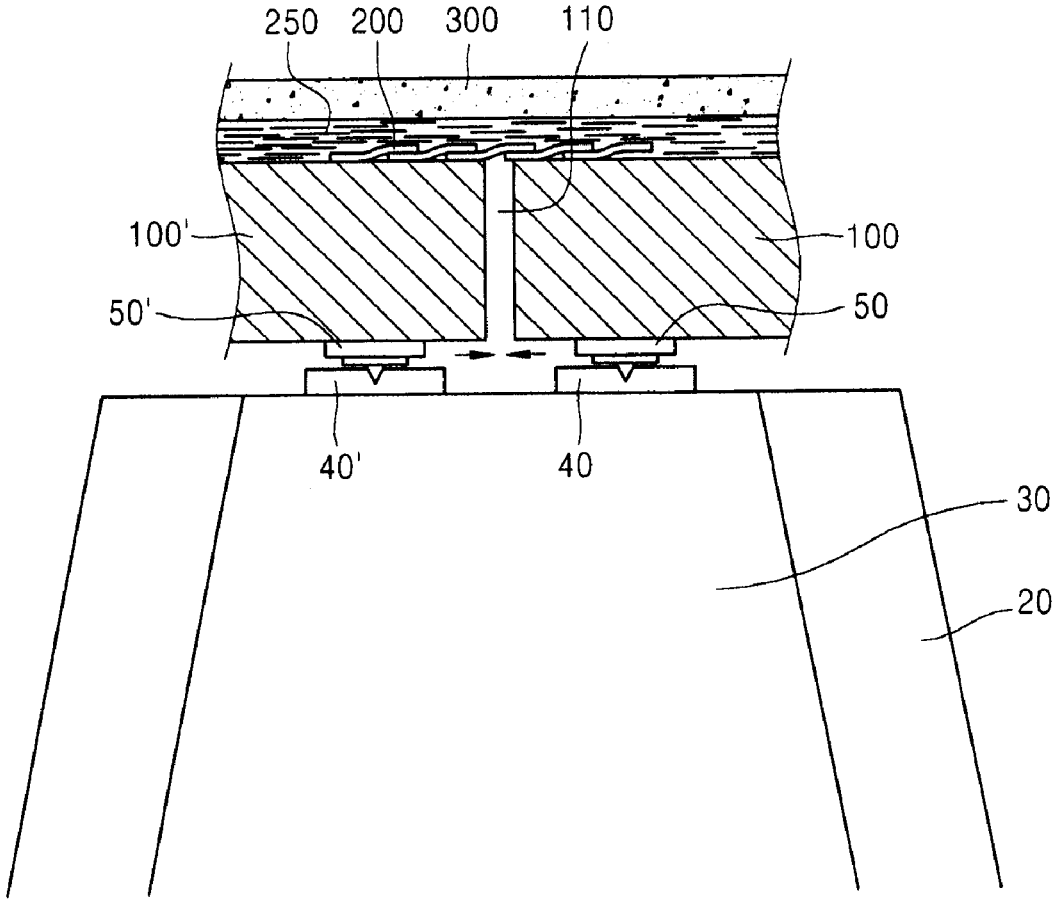
FIG. 5 is a sectional view of the anti-expansion joint bridge according to the exemplary embodiment of the invention after construction.
Figure 6:
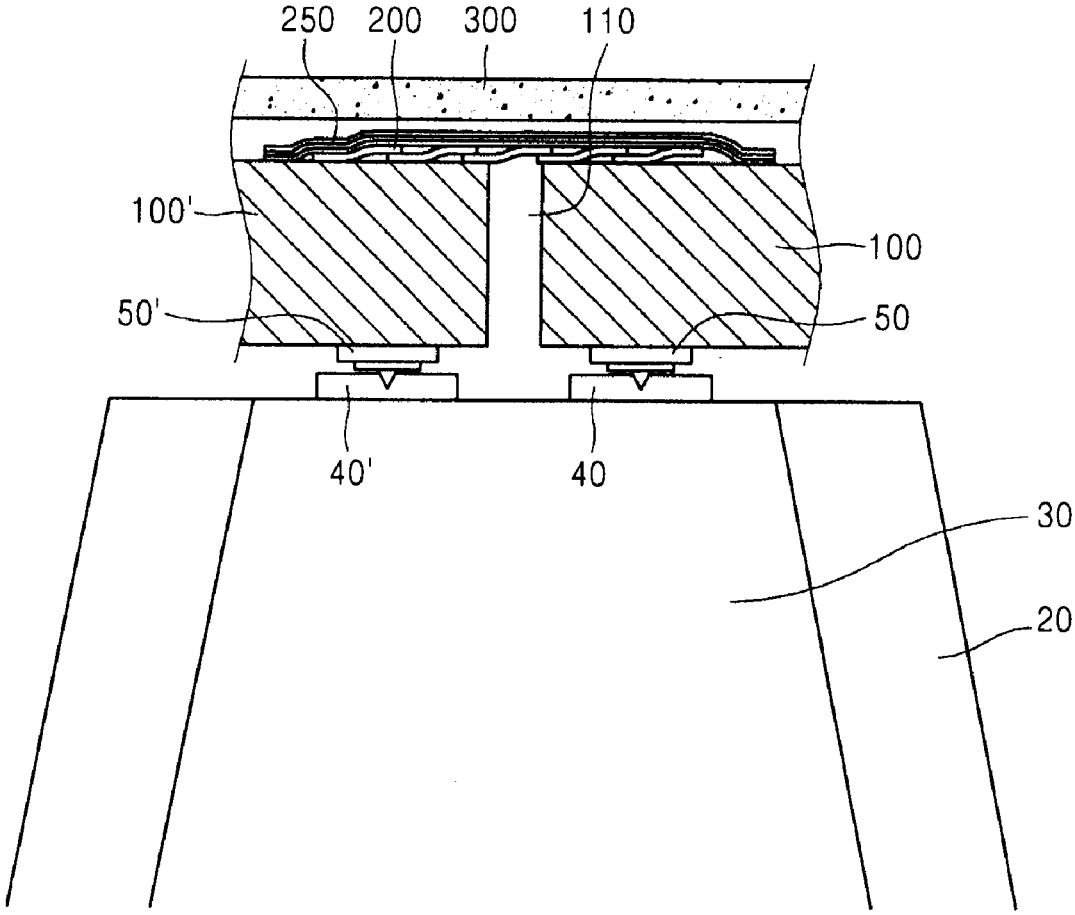
FIG. 6 is a sectional view of another example of a siding plate of the anti-expansion joint bridge according to the exemplary embodiment of the invention.

FIG. 5 is a sectional view of the anti-expansion joint bridge according to the exemplary embodiment of the invention after construction, and FIG. 6 is a sectional view of another example of a siding plate of the anti-expansion joint bridge according to the exemplary embodiment of the invention.

Referring to FIGS. 5 and 6, the sling membranes 250 are interposed between the ascon part 300 and the sliding plate 200 to cover the sliding plates 200. With this structure, the plurality of sliding plates 200 cooperate to prevent expansion and contraction force from being transferred to the surface of the ascon part 300 upon expansion and contraction of the girders 100, 100'. At this time, the sliding plates 200 move inside the receiving portions 220.

Here, the sliding plate 200 and the ascon part 300 are separated from each other by the sliding membranes 250 stacked one above another. Thus, as the sliding plates 200 are moved by expansion and contraction of the girders 100, 100', each of the sliding membranes 250 is also moved by the movement of the sliding plates 200, so that the uppermost part of the sliding membranes 250 prevents the expansion and contraction of the girders 100, 100' from affecting the ascon part 300.

Specifically, if the sliding plates 200 directly contact the ascon part 300, the sliding plates 200 are subjected to significant resistance from the ascon part 300 and thus cannot be smoothly moved upon expansion and contraction of the ascon part 300 and the girders 100, 100'.

Thus, in the anti-expansion joint bridge according to the embodiment, the plurality of sliding membranes 250 is formed of a synthetic resin and stacked on the sliding plates 200, and the ascon part 300 is continuously formed on the sliding membranes 250 as in a general flat road.

Advantageously, the sliding membranes 250 may be formed in a two or three-layer structure on the sliding plates 200.

Further, in the case where the sliding membranes 250 are stacked on the sliding plates 200 and the ascon part 300 is then formed on the sliding membranes 250, the sliding plates 200 serve as a cast before the ascon part 300 is hardened, thereby reducing time and cost in construction of the bridge.

As described above, particularly, in the case where the sliding membranes 250 are stacked on the sliding plates 200 and the ascon part 300 is then formed on the sliding membranes 250, the girders 100, 100' can be continuously arranged, so that load from vehicles running on the ascon part 300 is not concentrated at a certain place thereon, thereby protecting the bridge from concentration of excessive load, a more comfortable driving experience to passengers in the vehicles, and less abrasion to tires of the vehicles through low friction between the tires and the ascon part.

Here, the sliding film 250 may be formed of heat-resistant synthetic resin capable of withstanding heat from the ascon part 300, which is heated to 160 to 200° C. during installation of the ascon part on the bridge.

For example, the sliding membranes 250 may be made of polyester. Obviously, the sliding plates 200 may be formed of any other synthetic resins capable of avoiding interference with the ascon part 300.

Therefore, it is desirable that the ascon part 300 not be affected by expansion and contraction of the girders 100, 100' while covering all of the girders 100, 100'.

Further, the sliding membranes 250 may be formed of a synthetic resin and have a plate shape so as to allow smooth sliding of the sliding membranes 250 with respect to each other.

In particular, the sliding membranes 250 may be formed of a highly heat resistant synthetic resin to prevent deformation of the sliding membrane in terms of properties or shape thereof due to heat from the ascon part 300 during installation of the ascon part 300 on the sliding membranes 250.

Consequently, the sliding membranes 250 allow the sliding plates 200 to smoothly move independent of the ascon part 300 upon movement of the sliding plates 200 due to expansion and contraction of the girders 100, 100'.

Accordingly, the sliding membranes 250 may be stacked one above another in a scattered state. Alternatively, the plurality of sliding membranes 250 may be integrated and stacked in a multilayer structure so as to cover all of the sliding plates 200.

Figure 7:
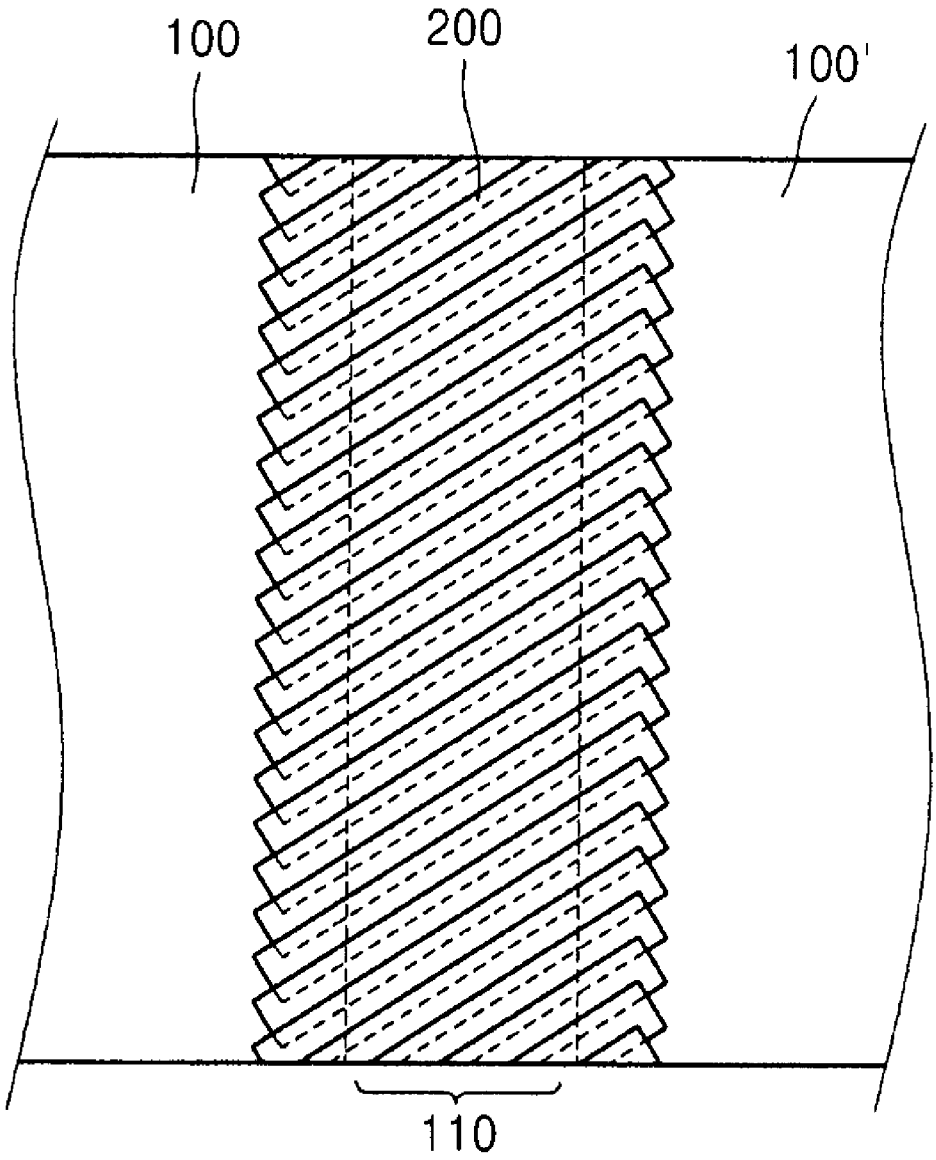
FIG. 7 is a plan view of the sliding plates installed on the bridge according to the exemplary embodiment of the present invention.

FIG. 7 is a front view of the sliding plates installed on the bridge according to the exemplary embodiment of the present invention.

As shown in FIG. 7, the sliding plates 200 may be diagonally disposed between the pair of girders 100, 100'.

Namely, the sliding plates 200 are diagonally spanned on girders at both sides. This arrangement of the sliding plates 200 prevents individual sliding plates from falling while allowing smooth movement of the sling plates 200 with respect to each other.

The sliding plates 200 may be laid on the girders 100, 100' or secured to the girder at one side instead of being secured to both girders 100, 100'.

When the plurality of sliding plates 200 is secured to the girders 100, 100' at both sides to cross each other, the sliding plates 200 may smoothly slide with respect to each other while being secured to the girders.

Next, construction of the anti-expansion joint bridge will be described hereinafter.

After an abutment is installed, girders 100, 100' are placed on the abutment. Here, a contraction groove 100 is defined between the girders 100, 100' so as to cope with variation in length due to thermal expansion. Here, the distance between the contraction grooves 100 is determined through a detailed bridge survey in consideration of a material for the girders and an annual temperature variation of the region where the bridge is built. The distance between the contraction grooves 100 is set to prevent the girders from contacting each other when the girders expand to the maximum extent possible.

Then, a reinforcing material such as a steel rod is placed on the girders 100, 100'. The reinforcing material secures coupling force between the girders and a concrete slab placed thereon later, thereby reinforcing the concrete slab.

Next, a plurality of sliding plates 200 is disposed on the girders 100, 100' to cover the contraction groove 110 between the girders 100, 100', and a viscous lubricant such as grease is deposited on the sliding plates 200. Alternatively, sliding membranes may be disposed on the sliding plates 200.

Next, the concrete slab is applied to the overall upper surface of the bridge including the sliding plates 200, followed by construction of an ascon part thereon.

As such, according to the embodiments, the anti-expansion joint bridge eliminates an existing expansion joint, which causes resistance and friction on the uppermost section of the bridge, so that the anti-expansion joint bridge prevents friction with a vehicle, thereby removing running noise of a vehicle while ensuring smooth running of a vehicle on the bridge.

Further, since the uppermost section of the bridge structure is kept flat, load is decentralized over the whole bridge structure instead of being applied to a specified part or a portion of the bridge structure, thereby minimizing breakage of the uppermost section of the bridge structure.

Furthermore, the anti-expansion joint bridge eliminates a need for frequent replacement of an expansion joint, which is caused by exposure to the outside and occurrence of resultant damage, thereby reducing economic loss.

Although some embodiments have been described herein, it should be understood by those skilled in the art that these embodiments are given by way of illustration only, and that various modifications, variations, and alterations can be made without departing from the spirit and scope of the invention. Therefore, the scope of the invention should be limited only by the accompanying claims and equivalents thereof.

What is claimed is:

1. An anti-expansion joint bridge, comprising:

a pair of girders separated from each other while constituting an upper structure of the bridge, the girders being able to expand and contract;

a plurality of sliding plates overlapping each other on the girders while covering a gap between the girders; and an asphalt concrete part covering the pair of girders together with the sliding plates;

wherein the sliding plates comprises a bent step and a receiving portion formed in a horizontal direction, wherein the plurality of sliding plates overlap each other side by side in the horizontal direction such that one end of each of the sliding plates is received in a receiving portion of an adjacent sliding plate and the other end of the sliding plate defines the receiving portion of the sliding plate.

2. The anti-expansion joint bridge of claim 1, wherein the one end of the sliding plate received in the receiving portion is movable in the receiving portion.

3. The anti-expansion joint bridge of claim 1, further comprising: a sliding membrane between the sliding plates and the asphalt concrete part to cover the sliding plates such that the sliding plates are slidable while being covered by the asphalt concrete part.

4. The anti-expansion joint bridge of claim 3, wherein the sliding membranes comprises a plurality of sliding membranes dispersed to overlap each other such that ends thereof cross each other.

5. The anti-expansion joint bridge of claim 3, wherein the plurality of sliding membranes are arranged in a multilayer structure.

6. The anti-expansion joint bridge of claim 3, wherein the sliding membrane is formed of heat resistant synthetic resin capable of withstanding heat from the asphalt concrete part during installation of the asphalt concrete part.

7. The anti-expansion joint bridge of claim 6, wherein the sliding membrane is formed of a polyester film.

* * * * *